United States Patent [19]

Hattori et al.

[11] 4,140,093

[45] Feb. 20, 1979

[54] AIR-FUEL RATIO CONTROLLING SYSTEM

[75] Inventors: Tadashi Hattori, Okazaki; Akira Takata; Tamotsu Fukuda, both of Toyota; Takamichi Nakase, Gamagori, all of Japan; Toyota Jidosha Kogyo Kabushiki Kaisha, 03, Toyota, both of Japan

[73] Assignee: Nippon Soken, Inc., Nishio

[21] Appl. No.: 792,768

[22] Filed: May 2, 1977

[30] Foreign Application Priority Data

May 28, 1976 [JP] Japan ..... 51-62540
May 28, 1976 [JP] Japan ..... 51-62541

[51] Int. Cl.[2] ..... F02D 1/04; F02D 35/00; F02D 33/00; F02B 15/00

[52] U.S. Cl. ..... 123/119 EC; 123/32 EE; 160/276; 160/285; 123/119 D; 123/124 B

[58] Field of Search ..... 123/119 EC, 119 E, 119 D, 123/119 DB, 129 R, 124 A, 127 B, 32 EA, 32 EE, 97 B; 160/276, 285

[56] References Cited

U.S. PATENT DOCUMENTS

| | | | |
|---|---|---|---|
| 3,949,551 | 4/1976 | Eichler et al. | 123/32 EE |
| 3,983,851 | 10/1976 | Hoshi et al. | 123/97 B |
| 4,046,118 | 9/1977 | Aono | 123/32 EE |
| 4,052,968 | 10/1977 | Hattori et al. | 123/32 EE |
| 4,057,042 | 11/1977 | Aono | 123/119 EC |

*Primary Examiner*—Wendell E. Burns
*Attorney, Agent, or Firm*—Cushman, Darby & Cushman

[57] ABSTRACT

An air-fuel ratio controlling system for an internal combustion engine including a control circuit for controlling, in accordance with a detected air-fuel ratio, the operation of a drive motor of a control valve mounted in an additional air supply passage. The control circuit includes a timing pulse generator for generating timing pulses synchronized with a running speed of the engine and thus the control valve is intermittently rotated by a predetermined amount in response to the timing pulses. By increasing the frequency of the timing pulses during the periods of rapid acceleration and deceleration, a response to the change in the engine speed is further improved.

15 Claims, 10 Drawing Figures

AIR-FUEL RATIO CONTROLLING SYSTEM

The present invention relates to an air-fuel ratio controlling system for internal combustion engines.

To ensure the maximum efficiency of an engine modified for automobile exhaust emission control purposes or to ensure the optimum purification of exhaust gases by an exhaust gas cleaning catalyst mounted in an engine for exhaust emission control purposes, the air-fuel ratio of mixtures supplied to the engine must always be controlled properly by means of additional air, or alternately the amount of secondary air supplied to the catalyst must be properly controlled.

A control system of this type has been proposed in which the air-fuel ratio of the mixture is detected by an air-fuel ratio detector based on the concentration of an exhaust constituent, e.g., oxygen in the exhaust gases, and a control valve is continuously operated in accordance with the output signal of the detector, thus controlling the flow rate of correcting additional air and thereby adjusting the air-fuel ratio of the mixture.

With this prior art system, generally a motor is employed as a drive unit for driving the control valve, and the air-fuel ratio of the mixture is generally controlled by maintaining the operating speed of the motor at a constant value, that is, the operating speed is set at the optimum value so that the control range of air-fuel ratio is minimized under the steady-state as well as transient operating conditions of the engine.

The problem with this prior art system is that since the control valve is always operated continuously and since the effect of the delay time factor is not practically taken into consideration, even if the operating speed is set at the optimum value as mentioned previously, due to the operating speed being held constant, the air-fuel ratio of the mixture is varied considerably under the effects of the delay time factor between the instant at which the air-fuel ratio of the mixture is changed in the intake system by the additional air and the instant at which the change is detected by the detector, thus increasing the control range of the air-fuel ratio and thereby making it impossible to ensure satisfactory control throughout a wide operating range of the engine.

Particularly, there is the disadvantage that under low load and speed operation of the engine where the amount of intake air is small, the delay time is increased thus causing a hunting phenomenon and thereby making it impossible to ensure a full display of the purification capacity of the catalytic converter, and moreover a surging phenomenon is caused during the running of the vehicle, thus deteriorating the drivability.

With a view to overcoming the foregoing deficiencies of the prior art, it is therefore an object of this invention to provide an improved air-fuel ratio controlling system which minimizes variation of the air-fuel ratio of mixtures due to the delay time of an engine.

This invention thus comprises an air-fuel ratio controlling system including an additional air passage for supplying additional air into the intake system or exhaust system of an engine in accordance with the output of an air-fuel ratio detector mounted in the exhaust system, and a control valve mounted in the additional air passage to control the passage area thereof, wherein each time a timing pulse synchronized with the rotational speed of the engine is generated, the control valve is intermittently rotated by a predetermined amount, thus minimizing variation of the air-fuel ratio due to the delay time.

It is another object of this invention to provide such improved air-fuel ratio controlling system wherein the frequency of the timing pulses is increased during the periods of sudden acceleration and deceleration, thereby ensuring an improved response.

It is still another object of this invention to provide such improved air-fuel ratio controlling system wherein the amount of movement of the control valve during the periods of sudden acceleration or deceleration of the engine is increased as compared with that obtained under the steady-state operating conditions of the engine, thereby ensuring an improved response.

It is still another object of the invention to provide such improved air-fuel ratio controlling system wherein in addition to the operation of the control valve in response to the generation of each timing pulse, the control valve is operated the predetermined amount in response to a change from one state to the other of the output of the air-fuel ratio detector, thereby reducing variation of the air-fuel ratio due to the delay time and ensuring an improved response.

It is still another object of the invention to provide such improved air-fuel ratio controlling system wherein the predetermined amount of movement of the control valve in the opening direction is differed from that in the closing direction, thereby controlling the air-fuel ratio at any desired value.

The above and further objects and novel features of the present invention will be more readily understood from the following detailed description when the same is read in connection with the accompanying drawings. It is to be expressly understood, however, that the drawings are for the purpose of illustration only and are not intended as a definition of the limits of the present invention.

The present invention will now be described in greater detail with reference to the illustrated embodiments.

Figure 1:
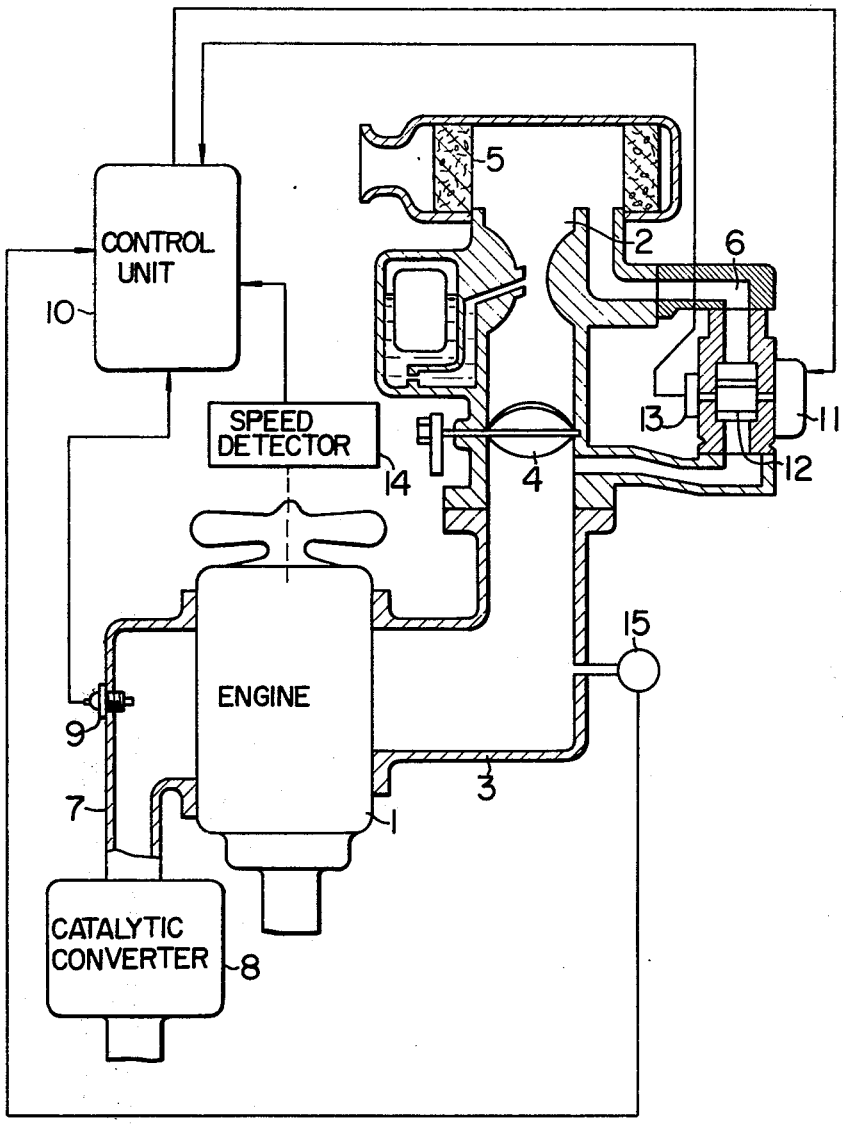
FIG. 1 is a schematic diagram showing the general construction of a first embodiment of the present invention.

Referring first to FIG. 1 showing the entire construction of the first embodiment of this invention, an engine 1 including combustion chambers is designed so that air-fuel mixture is supplied into the combustion chambers from a carburetor 2 through an intake manifold 3. This engine 1 is an ordinary four-cycle reciprocating gasoline engine.

In the intake system of the engine 1, a throttle valve 4 is mounted in the downstream portion of the carburetor 2, and an air cleaner 5 is provided upstream of the carburetor 2. An additional air passage 6 communicates the air cleaner 5 with the carburetor 2 downstream of the throttle valve 4, and the additional air passage 6 is disposed to bypass the fuel nozzle and the throttle valve 4 of the carburetor 2.

Disposed in the exhaust system of the engine 1 is an exhaust manifold 7, and a catalytic converter 8 incorporating an exhaust gas cleaning catalyst, e.g., a three-way catalyst, and also disposed in the exhaust manifold 7 is an air-fuel ratio detector 9 employing a metal oxide such as zirconium dioxide or titanium dioxide to detect the concentration of oxygen, a constituent, of the exhaust gases and thereby detect the air-fuel ratio of the mixture which is correlated with the oxygen content.

In the case of the air-fuel ratio detector 9 employing zirconium dioxide, an electromotive force of about 1 V is produced when the air-fuel mixture supplied to the engine 1 is richer than the stoichiometric air-fuel ratio, while an electromotive force of about 100 mV is produced when the air-fuel mixture supplied to the engine 1 is leaner than the stoichiometric air-furl ratio, and the electromotive force changes in a step fashion at around the stoichiometric air-fuel ratio.

A control unit 10 serves to intermittently cause a skipping rotation of a pulse motor 11 in a selected driving direction in accordance with the signals from various detectors including the air-fuel ratio detector 9, and the control unit 10 comprises various electronic circuits. The purpose of the pulse motor 11 is to open and close a control valve 12 mounted in the additional air passage 6, and its drive shaft is coupled to the shaft of the control valve 12. In this embodiment, the pulse motor 11 is of the four-phase two-phase excitation type.

The control valve 12 is an ordinary rectangular butterfly valve, and it is mounted in the additional air passage 6. The control valve 12 is provided with a fully closed position detecting switch 13 which is turned on when the control valve 12 is in its fully closed position and which is turned off when the control valve 12 is in any other position, and the output signal of the switch 13 is applied to the control unit 10.

A speed detector 14 functions to generate a signal in synchronism with the revolution of the crankshaft of the engine 1 or in accordance with the rotational speed of the engine 1, and in this embodiment the intermittent signal from the primary winding of the ignition coil ordinarily used in the ignition system of the engine 1, is utilized and this output signal is applied to the control unit 10.

Figure 2:
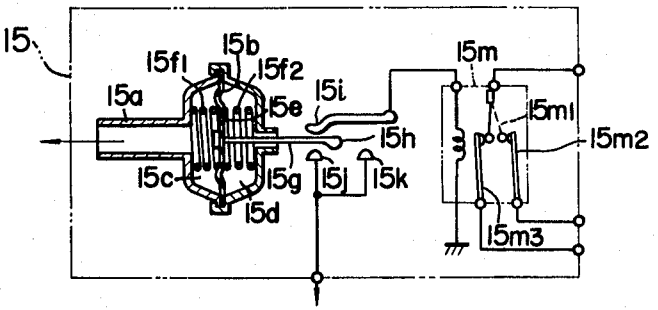
FIG. 2 is a partially sectional schematic diagram showing the construction of the acceleration/deceleration switch shown in FIG. 1.

An acceleration/deceleration switch 15 is mounted in the intake manifold 3 and the switch is electrically turned on and off in accordance with changes in the intake manifold vacuum. Namely, the switch is turned on in response to a sudden change in the intake vacuum as upon acceleration or deceleration of the engine 1, and its output signal is applied to the control unit 10. The construction of this acceleration/deceleration switch 15 is of a diaphragm type as shown in FIG. 2. As shown in the Figure, the switch 15 comprises two chambers **15*c* and 15*d* which are defined by a casing 15*a* and a diaphragm 15*b*, and the chanbers are communicated with each other through an orifice 15*e* of the diaphragm 15*b*. The chambers 15*c* and 15*d* are respectively provided with springs $15f_1$ and $15f_2$ which press the diaphragm 15*b*, and the chamber 15*c* is communicated with the intake manifold 3. An electrically conductive shaft 15*g* is securely attached to the diaphragm 15*b*, and a contact 15*h* is provided at the forward end of the shaft 15*g*. A sliding terminal 15*i* is disposed to always contact with the shaft 15*g*, and terminals 15*j* and 15*k* are disposed to respectively contact with the shaft 15*g* only at the predetermined positions thereof. A relay 15*m* is operated in response to the engagement and disengagement of the shaft 15*g* with the terminals 15*j* and 15*k*, so that contacts $15m_1$ and $15m_2$ are closed when the terminals are connected, while the contacts $15m_1$ and $15m_2$ are closed when the terminals are disconnected. In this way, the relay 15*m* is changed from one position to the other in response to the acceleration or deceleration of the engine 1**.

The speed detector 14 and the acceleration/deceleration switch 15 constitute a delay time detecting unit for detecting the delay time factor of the engine 1.

Figure 3:
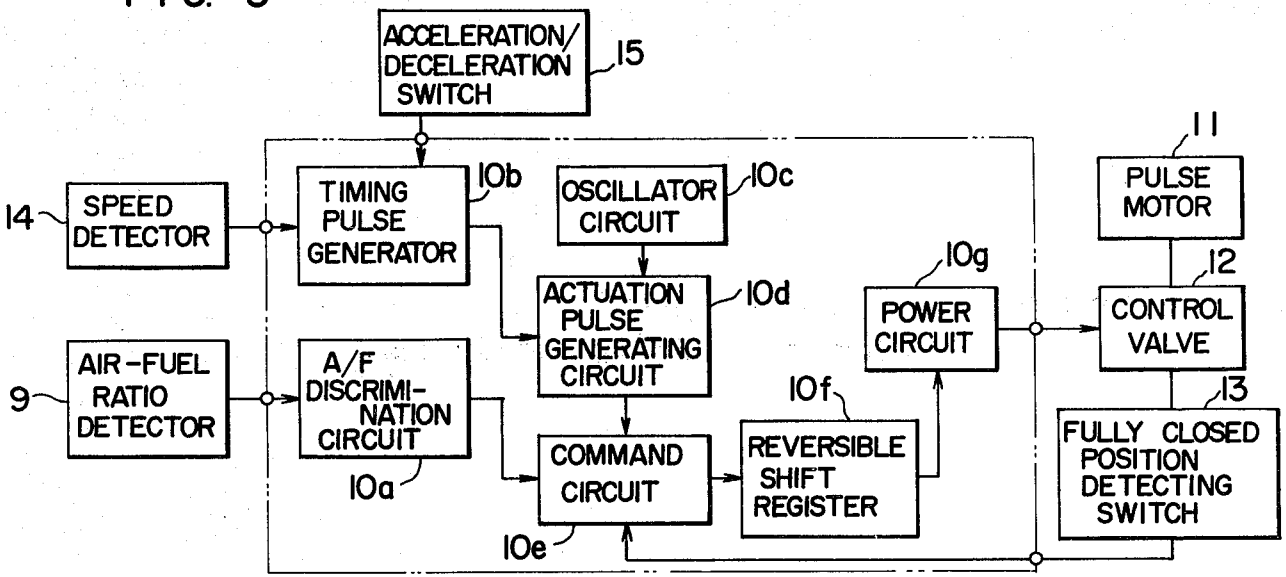
FIGS. 3 and 4 are respectively a block diagram and a wiring diagram of the control unit used in the first embodiment shown in FIG. 1.

Next, the control unit 10 will be described with reference to its block diagram shown in FIG. 3. The control unit 10 receives the air-fuel ratio signal from the air-fuel ratio detector 9 corresponding to the oxygen content of the exhaust gases which is closely related to the air-fuel ratio of the mixture, the output signals of the speed detector 14 and the acceleration/deceleration switch 15 constituting the delay time detecting unit and the output signal of the fully closed position switch 13 as its input signals. The control unit 10 comprises an A/F discrimination circuit **10*a* for discriminating the air-fuel ratio signal, a timing pulse generating circuit 10*b* for generating timing pulses at a period corresponding to the delay time factor of the engine 1, an oscillator circuit 10*c* for generating clock pulses having a predetermined frequency, an actuation pulse generating circuit 10*d* responsive to the timing pulse and the clock pulses for generating actuation pulses to actuate the pulse motor 11, a command circuit 10*e* for performing the logical control on the output signals of the A/F discrimination circuit 10*a* and the actuation pulse generating circuit 10*d*, a reversible shift register 10*f* whose output signals are sequentially shifted in accordance with the signals from the command circuit 10*e*, and a power circuit for controlling the energization of the pulse motor 11 in accordance with the output signals of the reversible shift register 10*f*, thereby properly operating the pulse motor 11**.

Next, the control unit 10 will be described in detail with reference to FIG. 4. The A/F discrimination circuit **10*a* comprises an input resistor 101, voltage dividing resistors 102 and 103, and a differential operational amplifier 104 (hereinafter referred to as an OP AMP), and the OP AMP 104 has its noninverting input terminal connected to the air-fuel ratio detector 9 through the input resistor 101 and its inverting input terminal connected to the voltage dividing point of the voltage dividing resistors 102 and 103. The output signal of the air-fuel ratio detector 9 is compared with the preset voltage predetermined by the voltage dividing resistors 102 and 103 (the voltage equal to the electromotive force produced by the air-fuel ratio detector 9 at around the stoichiometric air-fuel ratio), so that a "1" level output is produced at an output terminal A of the A/F discrimination circuit 10*a* when the output signal of the air-fuel ratio detector 9 is higher than the preset voltage or the air-fuel mixture is rich as compared with the stoichiometric air-fuel ratio, while a "0" level output is produced at the output terminal A when the output voltage of the air-fuel ratio detector 9** is lower than the preset voltage or the air-fuel mixture is lean as compared with the stoichiometric ratio, as shown in (c) of FIG. 5.

The timing pulse generating circuit 10b comprises a reshaper circuit including resistors 105, 107 and 108, a capacitor 106 and a transistor 109, a binary counter 110 and a differential pulse circuit including an inverter, a resistor 112, a capacitor 113 and an AND gate 114. Thus, the pulse signals produced from the primary winding of the ignition coil constituting the speed detector 14 are reshaped by the reshaper circuit and then subjected to frequency division in the binary counter 110. In this case, the dividing ratio is determined by the acceleration/deceleration switch 15, and in this embodiment it is preset so that an output $Q_1$ (the output subjected to ½ frequency division) is produced during the periods of acceleration and deceleration, and an output $Q_3$ (the output subjected to ⅛ frequency division) is produced under other operating conditions. The differentiated pulse circuit produces positive differentiated pulses from the frequency divided outputs of the binary counter 110 as shown in (b) of FIG. 5. It will thus be seen that these differenciated pulses or timing pulses are produced in synchronism with the engine speed and have a period inversely proportional to the engine speed, and the period of these differentiated pulses during the periods of acceleration and deceleration is ¼ the period produced during the normal operation. The oscillator circuit 10c comprises inverters 115 and 116, a resistor 117 and a capacitor 118, and it produces basic clock pulses for operating the pulse motor 11. The actuation pulse generating circuit 10d comprises an R-S flip-flop including NOR gates 119 and 120, a NOR gate 121 and a decade counter 122. The decade counter 122 is so designed that when a "1" level differentiated pulse is applied to its reset terminal, all of its outputs $Q_0$ to $Q_9$ are reset to the "0" level. The count proceeds each time the clock pulse applied to the carry-in terminal CI goes from the "0" level to the "1" level, and an output is produced one by one at $Q_0, Q_1, \ldots$, and $Q_9$ in this order. In this embodiment, the decade counter 122 is designed to start counting all over again when it has counted to the base 10, and a "1" level signal is produced at its carry-out terminal CO upon each counting to the base 10. In the R-S flip-flop, the timing pulse from the timing pulse generating circuit 10b triggers the NOR gate 119 causing its output to go to the "0" level, so that the NOR gate 121 is opened and the clock pulses from the oscillator circuit 10c are applied to the carry-in terminal CI of the decade counter 122. Simultaneously, the decade counter 122 is reset by the timing pulse to start counting from the time of the application of the timing pulse, so that when i clock pulses are counted, the $Q_i$ output goes to the "1" level and the NOR gate 120 of the R-S flip-flop is triggered. Consequently, the output of the NOR gate 119 goes to the "1" level and the NOR gate 121 is closed, thus causing the decade counter 122 to stop counting. As a result, as shown in (d) of FIG. 5, i clock pulses (namely, the number of pulses is i) are generated for every timing pulse, namely, actuation pulses are generated for the duration of a predetermined time interval as the output of the NOR gate 121. In this embodiment, the number of actuation pulses is preset at the optimum value so as to reduce the control range of the air-fuel ratio under the steady-state conditions as well as the transient conditions.

The fully closed position detecting switch 13 comprises a resistor 13a and a switch 13b, and it is so designed that when the control valve 12 is closed to the fully closed position, the switch, 13b is closed and the output at an output terminal G goes to the "0" level.

The output signals of the A/F discrimination circuit 10a, the actuation pulse generating circuit 10d and the fully closed position detecting switch 13 are applied to the command circuit 10e which in turn produces the required forward, reverse and stop signals for the pulse motor 11.

The command circuit 10e comprises an inverter 123 and AND gates 124 and 125, and it logically controls the pulse motor 11. When pulse signals are applied to an input terminal P of the reversible shift register 10f which receives as its input signals the output of the NAND gates 124 and 125 of the command circuit 10e, its output terminals $Q_1$, $Q_2$, $Q_3$ and $Q_4$ are sequentially shifted. On the contrary, when the pulse signals are applied to an input terminal C of the reversible shift register 10f, the output terminals $Q_4$, $Q_3$, $Q_2$ and $Q_1$ are sequentially shifted in this order. The output terminals $Q_1$, $Q_2$, $Q_3$ and $Q_4$ are connected to the power circuit 10g comprising resistors 126, 127, 128 and 129, transistors 130, 131, 132 and 133 and back electromotive force absorbing diodes 134, 135, 136 and 137, and the power circuit 10g is in turn connected to field coils $C_1$, $C_2$, $C_3$ and $C_4$ of the four-phase pulse motor 11. When the pulse signals are applied to the input terminal P of the reversible shift register 10f, the transistors 130, 131, 132 and 133 are sequentially turned on, and the coils $C_1$, $C_2$, $C_3$ and $C_4$ of the pulse motor 11 are similarly energized two phases at a time. Consequently, the rotor of the pulse motor 11 is rotated in the direction of the arrow in FIG. 4, and the control valve 12 is rotated in a direction which opens it. On the contrary, when the pulse signals are applied to the other input terminal C, the rotor of the pulse motor 11 is rotated in a direction opposite to the direction of the arrow in FIG. 4, and the control valve 12 is rotated in a direction which closes it.

The control unit 10 and the pulse motor 11 are supplied with power from a battery 201 through a switch 200 operatively associated with the key switch of the engine 1.

In the embodiment described above, the carburetor 2 is of the type which meters fuel in the usual manner, and it is identical with the known carburetors except that it has been adjusted to produce a mixture which is slightly rich in fuel as compared with the air-fuel ratio of the desired air-fuel mixture to be controlled and obtained. The ordinary main air is mixed with the corresponding amount of fuel in the carburetor 2, and the resulting mixture is supplied to the engine 1 through the intake manifold 3. After the mixture has been burned in the engine 1, the exhaust gases are discharged to the atmosphere through the exhaust manifold 7 and the catalytic converter 8, and at this time the air-fuel ratio of the mixture is detected by the air-fuel ratio detector 9 mounted in a portion of the exhaust passage of the exhaust manifold 7. The output signal of the air-fuel ratio detector 9 is appled to the control unit 10 which in turn determines whether the air-fuel ratio of the mixture is smaller (richer) or greater (leaner) than the stoichiometric air-fuel ratio. When the mixture is richer, the pulse motor 11 is rotated in a skip movement fashion in a direction which opens the control valve 12 mounted in the additional air passage 6, whereas when the mixture is leaner, the pulse motor 11 is rotated in a skip movement fashion in a direction which closes the control valve 12, thus compensating the mixture by the additional air to control the air-fuel ratio at the stoichiometric ratio. During this operation, in order to prevent the A/F discrimination circuit 10*a* from rotating the control valve 12 further and moving it to an "overshoot position" when the air-fuel mixture fails to attain the stoichiometric air-fuel ratio even after the control valve 12 has been closed to the fully closed position, when the fully closed position detecting switch 13 detects that the control valve 12 is in the fully closed position, the switch 13*b* is closed and the NAND gate 125 is closed, thus stopping the application of the pulse signals to the reversible shift register 10*f* and thereby preventing the rotation of the pulse motor 11 in the direction which rotates the control valve 12 further in the closing direction.

Next, the manner in which the pulse motor 11 is controlled will be described with reference to FIG. 5. When the engine 1 is accelerated or decelerated as shown in (a) of FIG. 5, the acceleration/deceleration switch 15 is switched from one position to the other in accordance with the waveform shown in (a) of FIG. 5. In response to the signals from the speed detector 14 and the acceleration/deceleration switch 15, the timing pulse generating circuit 10*b* generates timing pulses as shown in (b) of FIG. 5. During the time interval indicated as time $t_1$ to $t_2$ or during the acceleration or deceleration period, the period of timing pulses is reduced to about ¼ the period obtained under the steady-state conditions, although it is dependent on the rotational speed of the engine 1. Consequently, the actuation pulse generating circuit 10*d* generates actuation pulses in synchronism with the timing pulses as shown in (d) of FIG. 5. On the other hand, the signal from the air-fuel ratio detector 9 which is variable in response to variation in the air-fuel ratio of the mixtures produced by the carburetor 2, is discriminated by the A/F discrimination circuit 10*a* which in turn produces an output as shown in (c) of FIG. 5.

Figure 5:
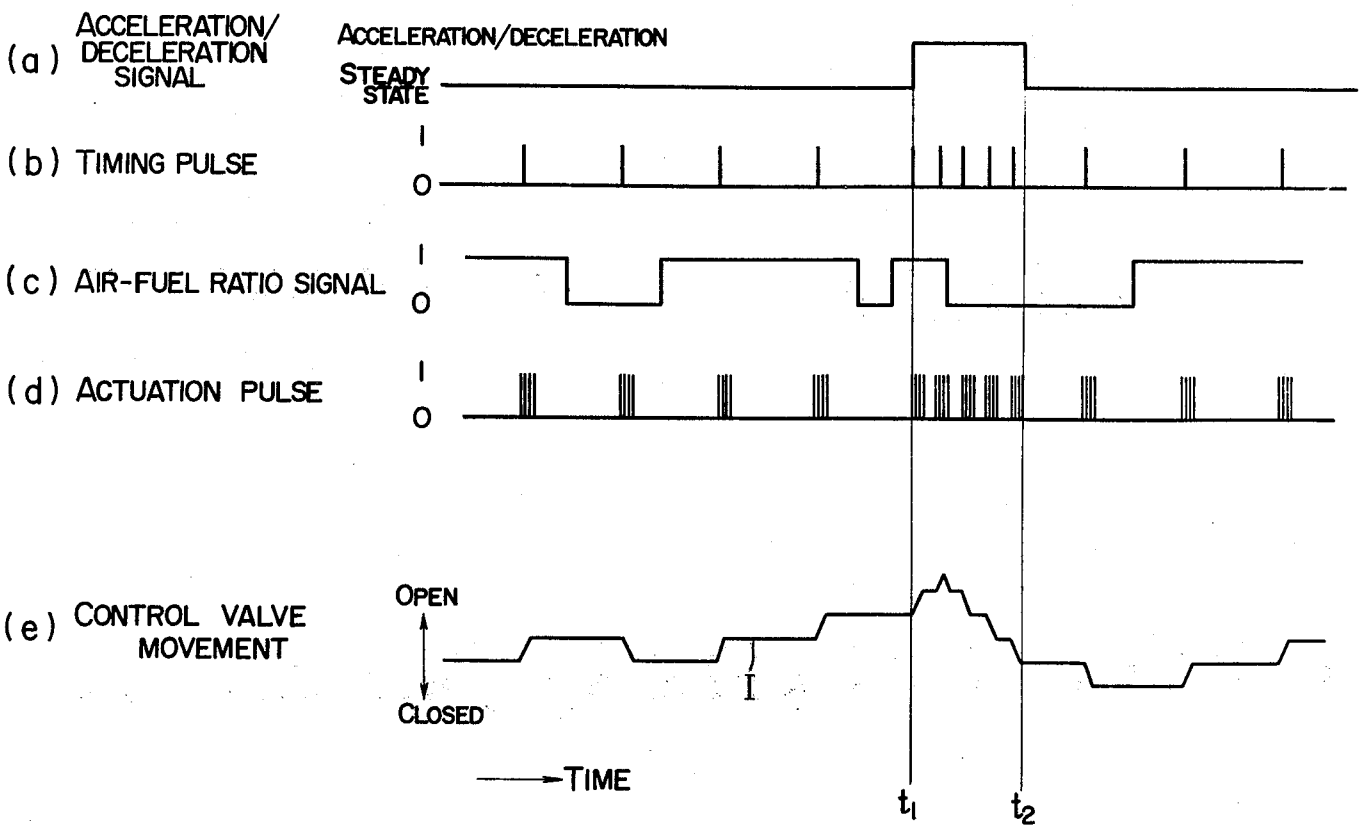
FIG. 5 is a waveform diagram useful in explaining the operation of the first embodiment.

Thus, the direction of rotation of the pulse motor 11 is determined by the air-fuel ratio signal shown in (c) of FIG. 5, and the timing of the rotation and the duration of the rotation (the rotational angle) of the pulse motor 11 are determined by the actuation pulses shown in (d) of FIG. 5, thus causing an intermittent rotation of the pulse motor 11. This operation is represented by the broken line I in (e) of FIG. 5 in terms of the movement, and it will be seen from FIG. 5 that the pulse motor 11 is operated in synchronism with the rotational speed of the engine 1 for a predetermined time period which is shorter than the period of the timing pulses, and the pulse motor 11 is temporarily stopped during the remaining time periods.

It will thus be seen that in accordance with this embodiment, in synchronism with a timing pulse the pulse motor 11 is operated through predetermined degrees of rotation during a predetermined time period and temporarily stopped during the remaining time period, and this operation is performed repeatedly. As a result, the amount of additional air supplied from the additional air passage 6 into the intake manifold 3 is increased and decreased intermittently.

This permits increase in the driving speed (the slope of the broken line I in FIG. 5*e*) of the control valve 12 by the pulse motor 11, thus improving the response of the control valve 12 and thereby reducing the control range of the air-fuel ratio of the mixture.

Further, in accordance with this embodiment, under transient conditions, such as, during the periods of acceleration or deceleration of the engine 1 where a sudden change occurs in the amount of air drawn into the engine 1, the period of timing pulse is reduced to about ¼ the ordinary period, and the operating cycle of the pulse motor 11 is reduced appreciably, thus rapidly changing the opening of the control valve 12 and thereby causing the air-fuel ratio of the mixture to rapidly return to the desired air-fuel ratio.

Furthermore, where variation in the amount of intake air is relatively small as under steady-state conditions, the period of timing pulses is increased and the operating cycle of the pulse motor 11 is increased, thus properly opening and closing the control valve 12.

Still further, in accordance with this embodiment, where the engine rotational speed is high and the amount of intake air is large, that is, where the delay time is short, the period of timing pulse is reduced in proportion to the engine rotational speed and the operating cycle of the pulse motor 11 is reduced, thus more rapidly changing the opening of the control valve 12 and thereby causing the air-fuel ratio of the mixture to rapidly return to the desired air-furl ratio without being subjected to a large variation due to the delay time factor of the engine 1. On the contrary, during the operation where the engine rotational speed is low and the amount of intake air is small, namely, where the delay time is long, the operating cycle of the pulse motor 11 is increased and the opening of the control valve 12 is changed more slowly on the whole, thus coping with the increased delay time of the engine 1. In this way, during low load and speed operation of the engine, any excessive supply of additional air is prevented, the control range of the air-furl ratio of mixtures is reduced and surging phenomenon of the engine 1 is prevented.

Thus, by virtue of the fact that the pulse motor 11 is intermittently operated and stopped in response to timing pulses whose period is varied in accordance with the delay time of the engine 1 and this operation is repeated to drive the control valve 12, the amount of additional air is always controlled properly throughout a wide range of engine operating conditions.

In the first embodiment, the necessary timing pulses are produced by utilizing the engine rotational speed and the sudden acceleration/deceleration condition of the engine as parameters.

In the second embodiment of the invention which will be described hereinafter, in addition to the engine rotational speed and sudden acceleration/deceleration condition, a timing pulse is produced when the output of the air-fuel ratio detector changes its previous state, thus reducing the variation of air-fuel ratio due to the delay time of the engine and thereby ensuring an improved response. The second embodiment is for the most part identical with the first embodiment, and therefore the differences between the embodiments will be described chiefly.

Figure 6:
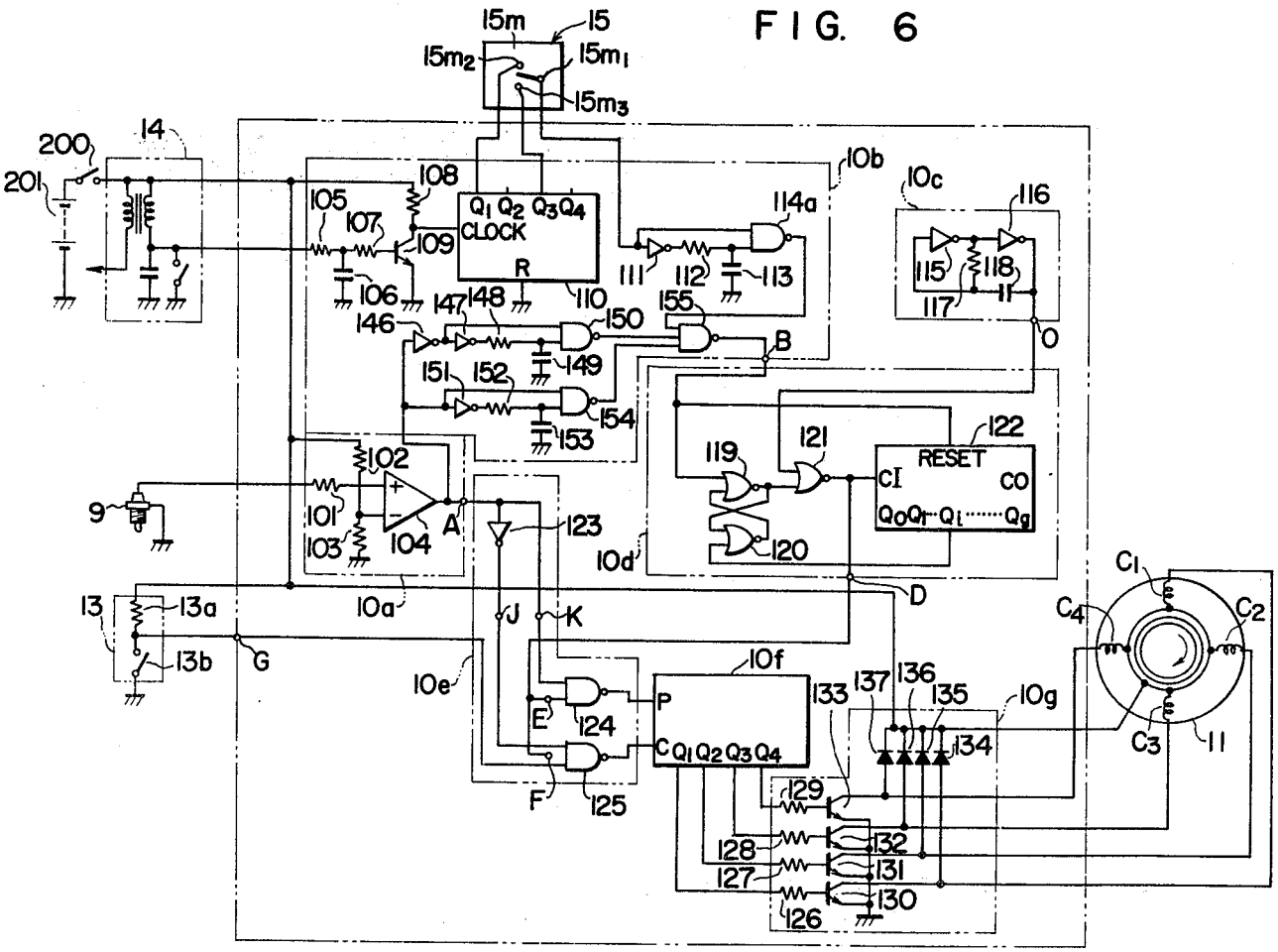
FIGS. 6 and 7 are respectively a wiring diagram showing a second embodiment of the invention and a waveform diagram useful in explaining the operation of the second embodiment.
Figure 7:
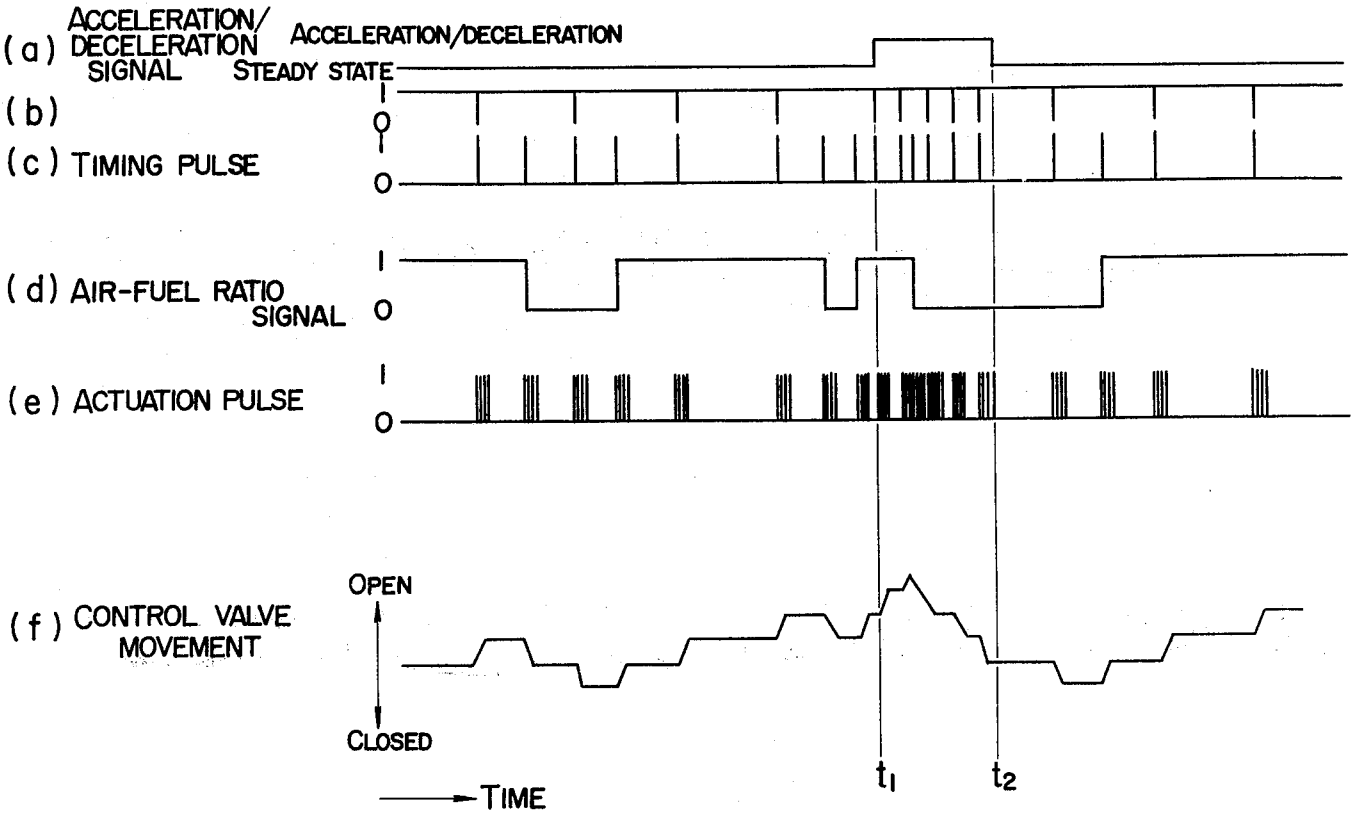

Referring to FIG. 6, as described in connection with FIG. 4, the timing pulse generating circuit 10*b* comprises, in addition to the reshaper circuit and the binary counter 110, a first differentiated pulse circuit including an inverter 111, a resistor 112, a capacitor 113 and a NAND gate 114*a*. This first differentiated pulse circuit generates negative differentiated pulses in synchronism with the frequency divided outputs of the binary counter 110 as shown in (b) of FIG. 7. The timing pulse generating circuit 10*b* further comprises a second differentiated pulse circuit including inverters 146 and 147, a resistor 148, a capacitor 149 and a NAND gate 150, a third differentiated pulse circuit similarly including an inverter 151, a resistor 152, a capacitor 153 and a NAND gate 154, and a NAND gate 155 connected to the first, second and third differentiated pulse circuits.

The second and third differentiated pulse circuits receive as their input signal the output of the A/F discrimination circuit 10*a*, so that when the output of the A/F discrimination circuit 10*a* goes from the "1" level to the "0" level (indicating a change from the rich to lean mixture), the second differentiated pulse circuit generates negative differentiated pulses, whereas when the output of the A/F discrimination circuit 10*a* changes from the "0" level to the "1" level (indicating a change from the lean to rich mixture), the third differentiated pulse circuit generates negative differentiated pulses. These three kinds of differentiated pulses are delivered through the NAND gate 155, and so the resulting output waveform represents, as shown in (c) of FIG. 7, the superposition of the differentiated pulses synchronized with the engine rotational speed and having a period varied by the acceleration/deceleration switch (FIG. 7(*b*)) and the differentiated pulses produced in response to changes of the air-fuel ratio signal produced from the A/F discrimination circuit 10*a*.

Figure 4:
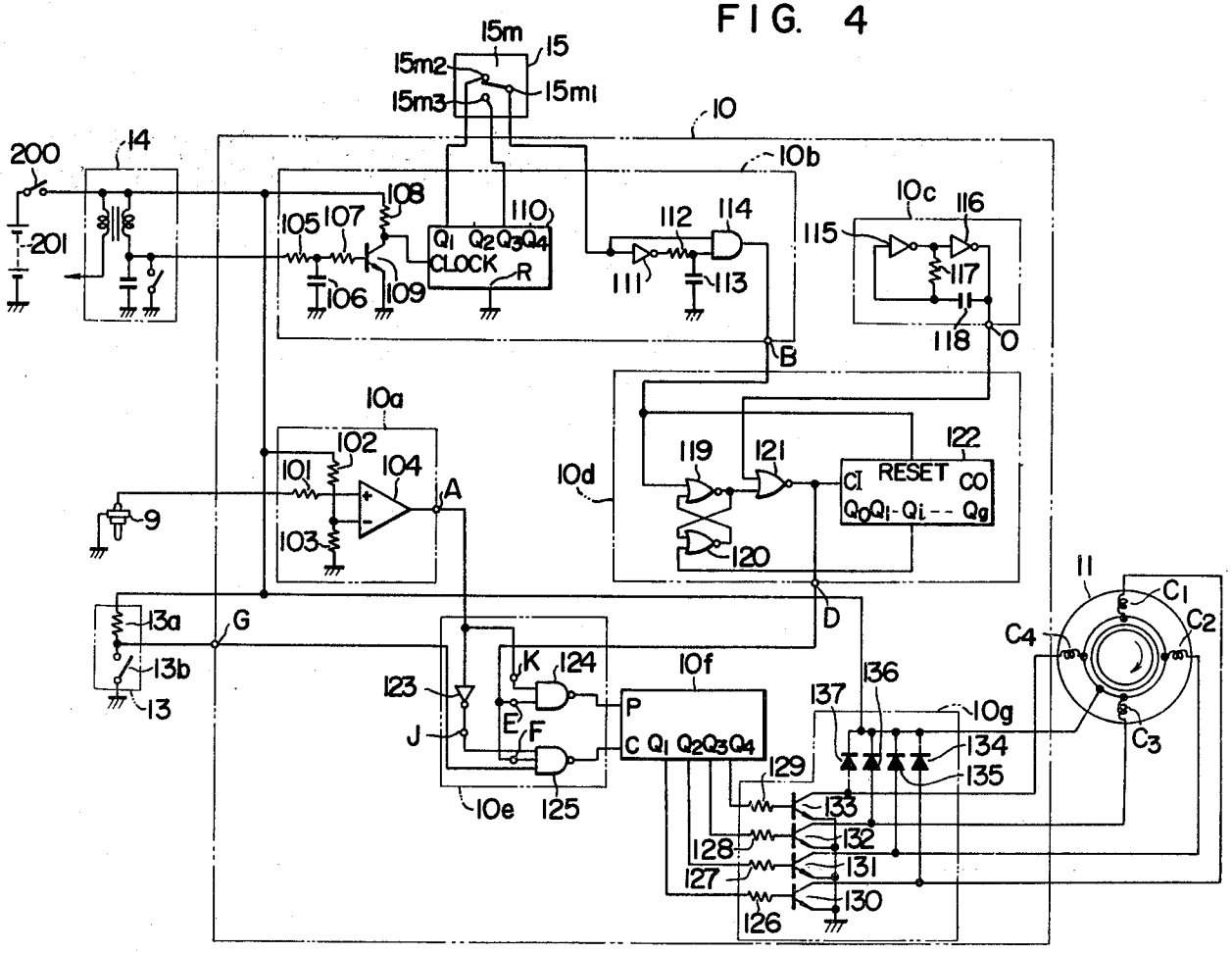

The remaining consturction is identical with the counterpart of the first embodiment of FIG. 4, and therefore it will not be described.

The operation of the second embodiment is as follows. In the like manner as the first embodiment, the pulse motor 11 is operated, in synchronism with each timing pulse, for a predetermined time through predetermined degrees of rotation, and the pulse motor 11 is stopped for the remainder of the period. As a result, the amount of additional air supplied from the additional air passage 6 into the intake manifold 3 is also increased and decreased intermittently. Thus, the driving speed of the control valve 12 by the pulse motor 11 (the slope of the broken line I in FIG. 7(*f*)) can be increased to ensure an improved operational response of the control valve 12 and thereby reduce the variation of air-fuel ratio.

Further, since the required timing pulses are produced from the differentiated pulses synchronized with the rotational speed of the engine 1 and the differentiated pulses synchronized with the changes in the state of the air-fuel ratio signal, even if the period of differentiated pulses synchronized with the engine rotational speed is selected long and the air-fuel ratio is caused to vary rapidly, the pulse motor 11 will be operated properly thus satisfactorily controlling the amount of additional air.

Thus, by virtue of the fact that in response to timing pulses produced in accordance with the delay time of the engine 1 and the air-fuel ratio signal, the pulse motor 11 is intermittently operated and stopped and this operation is repeatedly to operate the control valve 12, the amount of additional air is always properly controlled through a wide range of engine operating conditions.

Figure 8:
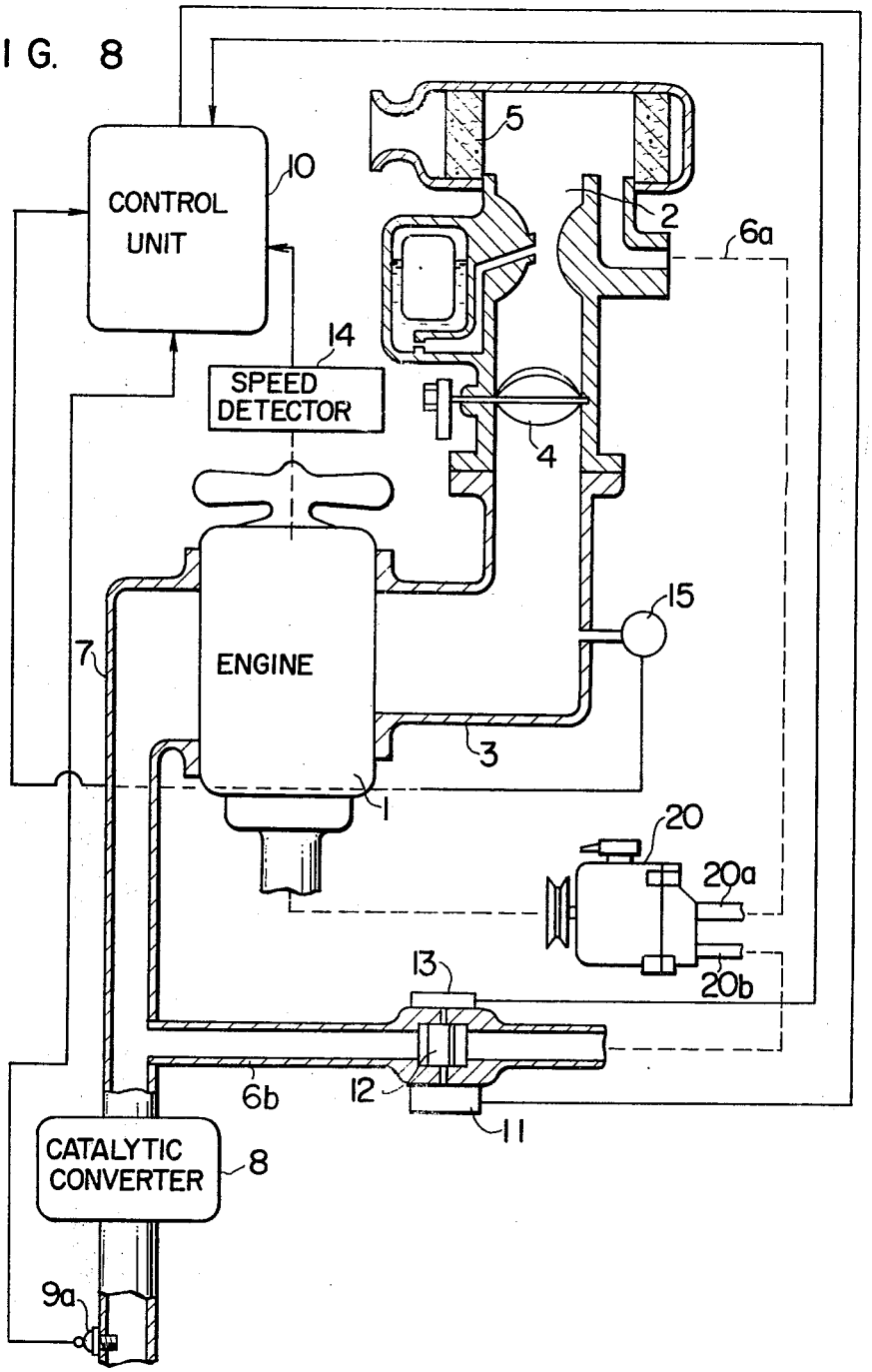
FIG. 8 is a schematic diagram showing the general construction of a third embodiment of the invention.

FIG. 8 shows a third embodiment of the invention, and the third embodiment differs from the first and second embodiments in that while, in the first and second embodiments, the air-fuel ratio is controlled by additionally supplying correcting air into the intake system of an engine, in the third embodiment the air-fuel ratio is controlled similarly by additionally supplying correcting air into the exhaust system of an engine.

In the Figure, numeral 20 designates an air pump driven by an engine 1 and having its inlet port 20*a* communicated with an air cleaner 5 by way of a pipe 6*a* and its outlet port 20*b* communicated with an additional air passage 6*b*. The passage 6*b* is opened into an exhaust manifold 7 at a position which is upstream from an exhaust gas cleaning device 8 such as a three-way catalyst or after burner. Disposed in the passage 6*b* are a control valve 12 of the same type as shown in FIG. 1 to control the passage area thereof, a pulse motor 11 for driving the control valve 12 and a fully closed position detecting switch 13, and the amount of additional air supplied into the exhaust manifold 7 is controlled by these elements.

In the embodiment of FIG. 8, an air-fuel ratio detector 9 is mounted in the exhaust manifold 7 downstream of the exhaust gas cleaning device 8 to detect the oxygen content of the exhaust gases produced after the additional air had been supplied. A control unit 10 may be of the same type as shown in FIG. 4 or 6, and by the similar operation as described in connection with either the first embodiment or the second embodiment the air-fuel ratio of the gases (the exhaust gases plus the additional air) is properly controlled, and this control ensures reduced variation of the air-fuel ratio and improved response.

Figure 9:
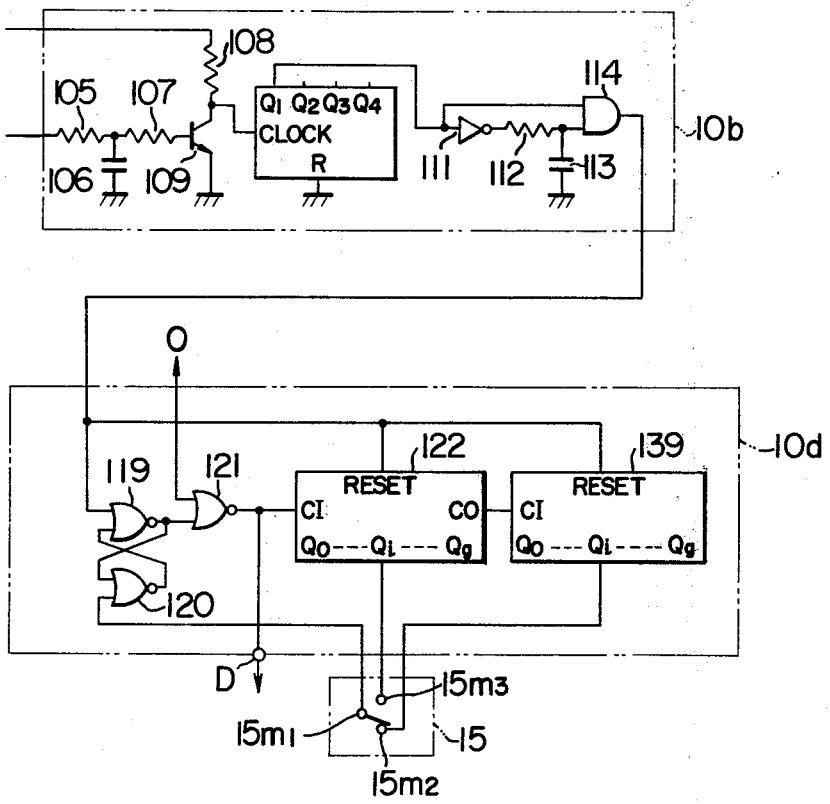
FIGS. 9 and 10 are wiring diagrams showing the principal parts of modifications of the control unit shown in FIGS. 4 and 6.

FIG. 9 is a circuit diagram showing the principal parts of a modification of the control unit shown in FIG. 4 or 6. While the control unit shown in FIG. 4 or FIG. 6 is designed so that during periods of sudden acceleration or deceleration the frequency of timing pulses is increased to rapidly change the opening of the control valve 12 to the proper valve, in the modification of FIG. 9 the timing pulses used consist of pulse signals having a frequency depending on the rotational speed of the engine so that in response to the arrival of the timing pulses the amount of movement of the control valve is increased during periods of sudden acceleration or deceleration of the engine over that provided under steady-state operating conditions of the engine, and an air-fuel ratio controlling system incorporating this modification is similarly capable of ensuring reduced variation of the air-fuel ratio and improved response.

This modification will now be described with reference to FIG. 9 showing a timing pulse generating circuit 10*b* and an actuation pulse generating circuit 10*d* of the control unit, and the remaining construction is the same with the counterpart of the control unit shown in FIG. 4. The timing pulse generating circuit 10*b* generates differentiated pulses in synchronism with the engine rotational speed, and sudden acceleration or deceleration of the engine does not have any effect on the differentiated pulses. The actuation pulse generating circuit 10*d* comprises an additional decade counter 139 in addition to all the elements of the circuit 10*d* shown in FIG. 4, and the carry-out terminal CO of the decade counter 122 is connected to the carry-in terminal CI of the decade counter 139 whose reset terminal Reset is connected, similarly with the decade counter 122, to the timing pulse generating circuit 10*b* so that the decade counter 139 is reset in response to each differentiated pulse from the timing pulse generating circuit 10*g*. The output terminals of the decade counters 122 and 139 are connected to the acceleration/deceleration switch 15 so that upon sudden acceleration or deceleration of the engine, the output of the decade counter 139 is applied to the NOR gate 120.

With the construction described above, the operation of the control unit is as follows. While, during periods of acceleration and deceleration of the engine, the period of timing pulses is not changed, the number of clock pulses produced in response to each timing pulse (the number of pulses applied from a terminal D to the command circuit 10*e*) is changed in accordance with the operational conditions of the engine. Namely, under steady-state operating conditions of the engine, the output of the decade counter 122 is applied to the NOR gate 120 so that the number of clock pulses applied from the terminal D to the command circuit 10*e* is between 1 and 9, while during periods of sudden acceleration and deceleration the number of clock pulses applied to the command circuit 10*e* is between 10 and 99.

Consequently, the duty ratio of actuation pulses is changed, and the running time of the pulse motor 11 is also changed, thus rapidly operating the control valve 12 during periods of acceleration and deceleration.

While the timing pulse generating circuit 10*b* shown in FIG. 9 is shown in the form of a circuit designed to generate differentiated pulses in synchronism with the engine rotational speed, it should readily be understood that the timing pulse generating circuit 10*b* be designed so that a timing pulse is generated in response to a change of the output of the A/F discrimination circuit 10*a* from its previous state as described in connection with FIG. 6.

Figure 10:
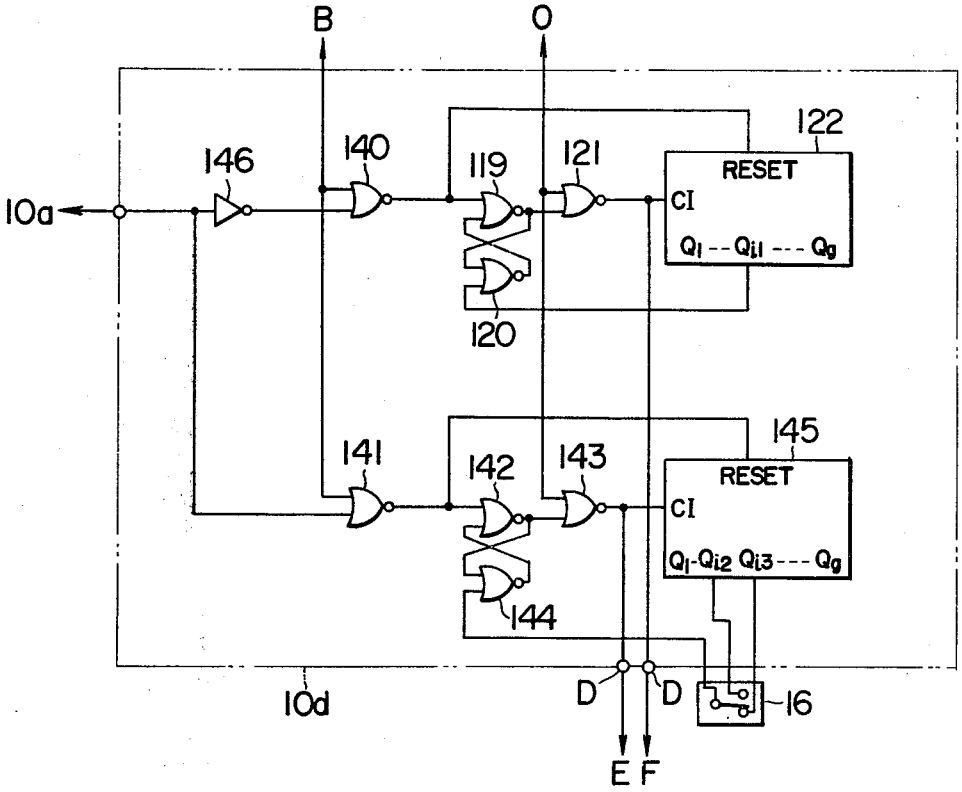

Further, while, in the previously described embodiments (FIGS. 4 and 6), the number of clock pulses generated from the actuation pulse generating circuit 10*d* in response to each timing pulse is selected the same for opening and closing the control valve and hence the running time of the control valve is made the same for the opening and closing thereof, it is possible to modify the actuation pulse generating circuit 10*d* as shown in FIG. 10 so that it further comprises NOR gates 140, 141 and 143, NOR gates 142 and 144 constituting an R-S flip-flop, a decade counter 145 and an inverter 146 connected to the A/F discrimination circuit 10*a*, with one input terminals of the NOR gates 140 and 141 connected to an output terminal B of the timing pulse generating circuit 10*b*, the other input terminal of the NOR gate 140 connected to the inverter 146, and the other input terminal of the NOR gate 141 connected to the A/F discrimination circuit 10*a*, whereby the decade counter 122 determines the number of actuation pulses generated for closing the control valve, while the number of actuation pulses generated for opening the control valve is determined by the decade counter 145.

With this construction, the number of clock pulses generated in response to each timing pulse for opening the control valve can be differed from that generated for closing the same, thus causing the degrees of rotation of the control valve 12 for opening the same to be different from that for closing the same and thereby making it possible to control the mixture at any desired air-fuel ratio other than the stoichiometric ratio.

Thus, by providing, as shown in FIG. 10, a warm-up detector 16 (e.g., an engine cooling water temperature sensor) which is adapted for switching operations in accordance with the warming-up condition of the engine 1 and thereby changing the outputs of the decade counter 145 through the warm-up detector 16, it is possible, during the warming up period, to control the air-fuel ratio of the mixture at a value smaller than the stoichiometric air-fuel ratio and thereby ensure stable warming up operation of the engine. The decade counters are preset so that $Qi_1 = Qi_3 > Qi_2$. Of course, the preset air-fuel ratio may be changed suitably depending on the setting of the decade counters.

While, in the embodiments described above, the drive means comprises a pulse motor, any DC or AC motor may also be employed, or alternately any of the electrical actuators as well the mechanical actuators may be employed.

Further, while the delay time detecting unit comprises the ignition system or acceleration/deceleration switch, any of other sensors for detecting such delay time factors as intake vacuum, intake air amount, venturi vacuum, throttle opening, vehicle speed etc., may also be employed singly or in combination thereof.

Still further, if the detector used is of the type whose output varies analogically, the frequency divider circuit may for examply be replaced with a voltage-to-frequency converter or the like so as to analogically change the period of timing pulses.

What is claimed is:

1. In an air-fuel ratio controlling apparatus for an internal combustion engine including:

a combustion chamber for producing a power therein, an intake system operatively communicated with said combustion chamber for supplying thereto air-fuel mixture, an exhaust system operatively communicated with said combustion chamber for conveying exhaust gas from said combustion chamber to the atmosphere, said exhaust system including means for purifying said exhaust gas, additional air supplying pipe communicated with at least one of said systems for supplying additional air thereto, air-fuel ratio detecting means disposed in said exhaust system for detecting air-fuel ratio of the air-fuel mixture supplied with the additional air, control means operatively disposed in said additional air supplying pipe for variably controlling the amount of the additional air to be supplied, drive means operatively connected with said control means for driving the same, and a control circuit electrically connected with said air-fuel ratio detecting means and said drive means for actuating said drive means in response to the detected air-fuel ratio, said control circuit comprising:

a timing pulse generator for generating timing pulses in a timed relationship with a running speed of said engine; and an actuating circuit for intermittently actuating said drive means upon receiving said timing pulses, said actuating circuit being actuated for a predetermined period of time at each of said timing pulses, whereby the amount of the additional air is intermittently controlled in accordance with the detected air-fuel ratio.

2. A control circuit according to claim 1 further comprising, means for changing a frequency of said timing pulses during a rapid change of the operational condition of said engine.

3. In an air-fuel ratio controlling apparatus for an internal combustion engine including:

a combustion chamber for producing a power therein, an intake system operatively communicated with said combustion chamber for supplying thereto air-fuel mixture, an exhaust system operatively communicated with said combustion chamber for conveying exhaust gas from said combustion chamber to the atmosphere, said exhaust system including means for purifying said exhaust gas, additional air supplying pipe communicated with at least one of said systems for supplying additional air thereto, air-fuel ratio detecting means disposed in said exhaust system for detecting air-fuel ratio of the air-fuel mixture supplied with the additional air, control means operatively disposed in said additional air supplying pipe for variably controlling the amount of the additional air to be supplied, drive means operatively connected with said control means for driving the same, and a control circuit electrically connected with said air-fuel ratio detecting means and said drive means for actuating said drive means in response to the detected air-fuel ratio, said control circuit comprising:

a timing pulse generator for generating timing pulses in a timed relationship with a running speed of said engine;

an actuating circuit for intermittently actuating said drive means upon receiving said timing pulses, whereby the amount of the additional air is intermittently controlled in accordance with the detected air-fuel ratio, operation detecting means for detecting and producing a signal during periods of rapid change in the operational condition of said engine; and means for altering the rate of change in the amount the additional air per said timing pulse in response to said signal.

4. A control circuit according to claim 1, wherein said timing pulse generator also generates timing pulses when the output from said air-fuel ratio detecting means is changed.

5. A control circuit according to claim 1 further comprising, means for changing a rate of a moving degree of said control means disposed in said additional air supplying pipe in one direction per said timing pulse to a moving degree of said control means in the other direction.

6. Apparatus as in claim 1 wherein said purifying means comprises a catalytic converter.

7. Apparatus as in claim 3 wherein said purifying means comprises a catalytic converter.

8. In an air-fuel ratio controlling apparatus for an internal combustion engine including:

a combustion chamber for producing a power therein, an intake system operatively communicated with said combustion chamber for supplying thereto air-fuel mixture, an exhaust system operatively communicated with said combustion chamber for conveying exhaust gas from said combustion chamber to the atmosphere, additional air supplying pipe communicated with said intake system for supplying additional air thereto, air-fuel ratio detecting means disposed in said exhaust system for detecting air-fuel ratio of the air-fuel mixture supplied with the additional air, control means operatively disposed in said additional air supplying pipe for variably controlling the amount of the additional air to be supplied, drive means operatively connected with said control means for driving the same, and a control circuit electrically connected with said air-fuel ratio detecting means and said drive means for actuating said drive means in response to the detected air-fuel ratio, said control circuit comprising:

a timing pulse generator for generating timing pulses in a timed relationship with a running speed of said engine; and an actuating circuit for intermittently actuating said drive means upon receiving said timing pulses, said actuating circuit being actuated for a predetermined period of time at each of said timing pulses, whereby the amount of the additional air is intermittently controlled in accordance with the detected air-fuel ratio.

9. A control circuit according to claim 8 further comprising, means for changing a frequency of said timing pulses during a rapid change of the operational condition of said engine.

10. A control circuit according to claim 8, wherein said timing pulse generator also generates timing pulses when the output from said air-fuel ratio detecting means is changed.

11. A control circuit according to claim 8 further comprising, means for changing a rate of a moving degree of said control means disposed in said additional air supplying pipe in one direction per said timing pulse to a moving degree of said control means in the other direction.

12. In an air-fuel ratio controlling apparatus for an internal combustion engine including:

a combustion chamber for producing a power therein, an intake system operatively communicated with said combustion chamber for supplying thereto air-fuel mixture, an exhaust system operatively communicated with said combustion chamber for conveying exhaust gas from said combustion chamber to the atmosphere, additional air supplying pipe communicated with said intake system for supplying additional air thereto, air-fuel ratio detecting means disposed in said exhaust system for detecting air-fuel ratio of the air-fuel mixture supplied with the additional air, control means operatively disposed in said additional air supplying pipe for variably controlling the amount of the additional air to be supplied, drive means operatively connected with said control means for driving the same, and a control circuit electrically connected with said air-fuel ratio detecting means and said drive means for actuating said drive means in response to the detected air-fuel ratio, said control circuit comprising:

a timing pulse generator for generating timing pulses in a timed relationship with a running speed of said engine;

an actuating circuit for intermittently actuating said drive means upon receiving said timing pulses, whereby the amount of the additional air is intermittently controlled in accordance with the detected air-fuel ratio, operation detecting means for detecting and producing a signal during periods of rapid change in the operational condition of said engine; and means for altering the rate of change in the amount the additional air per said timing pulse in response to said signal.

13. A control circuit according to claim 12 further comprising, means for changing a frequency of said timing pulses during a rapid change of the operational condition of said engine.

14. A control circuit according to claim 12, wherein said timing pulse generator also generates timing pulses when the output from said air-fuel ratio detecting means is changed.

15. A control circuit according to claim 12 further comprising, means for changing a rate of a moving degree of said control means disposed in said additional air supplying pipe in one direction per said timing pulse to a moving degree of said control means in the other direction.

* * * * *

UNITED STATES PATENT AND TRADEMARK OFFICE

CERTIFICATE OF CORRECTION

PATENT NO. : 4,140,093

DATED : February 20, 1979

INVENTOR(S) : Tadashi HATTORI, Akira TAKATA, Tamotsu FUKUDA and Takamichi NAKASE It is certified that error appears in the above—identified patent and that said Letters Patent is hereby corrected as shown below:

In the heading

Delete from [75] Inventors:

"Toyota Jidosha Kogyo Kabushiki Kaisha, 03, Toyota, both of Japan"

The Assignee information should read as follows:

[73] Assignees: Nippon Soken, Inc., Nishio
Toyota Jidosha Kogyo Kabushiki Kaisha, Toyota, both of Japan Signed and Sealed this First Day of April 1980

[SEAL]

Attest:

SIDNEY A. DIAMOND

Attesting Officer

Commissioner of Patents and Trademarks